US005714939A

United States Patent [19]

Song

[11] Patent Number: 5,714,939

[45] Date of Patent: Feb. 3, 1998

[54] METHOD OF DETECTING THE CLOGGING OF A FILTER INSTALLED IN A WASHING MACHINE

[75] Inventor: Bok-Nam Song, Incheon, Rep. of Korea

[73] Assignee: Daewoo Electronics Co., Ltd., Rep. of Korea

[21] Appl. No.: 719,884

[22] Filed: Sep. 25, 1996

[30] Foreign Application Priority Data

Sep. 29, 1995 [KR] Rep. of Korea ..... 95-33143

[51] Int. Cl.[6] ..... G08B 21/00

[52] U.S. Cl. ..... 340/607; 340/618; 68/12.05; 68/207

[58] Field of Search ..... 340/618, 623, 340/626, 450, 612, 620, 607; 68/12.05, 12.13, 12.21, 12.27, 207; 137/387, 395, 551

[56] References Cited

U.S. PATENT DOCUMENTS

| | | | |
|---|---|---|---|
| 4,195,500 | 4/1980 | Tobita et al. | 340/618 |
| 4,201,240 | 5/1980 | Case | 340/618 |
| 5,159,823 | 11/1992 | Fukuda et al. | 68/207 |
| 5,297,307 | 3/1994 | Baek | 68/12.05 |
| 5,477,731 | 12/1995 | Mouton | 340/607 |
| 5,565,851 | 10/1996 | Richards et al. | 340/618 |

*Primary Examiner*—Brent A. Swarthout
*Assistant Examiner*—Van T. Trieu
*Attorney, Agent, or Firm*—Beveridge, DeGrandi, Weilacher & Young, LLP

[57] ABSTRACT

Disclosed is a method of detecting the clogging of a filter installed in a washing machine by which a user can recognize the clogging of the filter. The method comprises the steps of detecting a first frequency using a liquid level sensor when a liquid level in an outer tub has reached a first liquid level, of recording a value of the first frequency in a memory section of the microcomputer, of demoting a second frequency using the liquid level sensor when a liquid level in the outer tub has reached a second liquid level which is formed in the outer tub while the washing cycle is being executed, of recording a value of the second frequency in the memory section of the microcomputer, of calculating a value of a third frequency by subtracting the value of the first frequency from the value of the second frequency, and of sending an operating signal to a signal lamp when the value of the third frequency is lower than a predetermined frequency range which is preset in the microcomputer. By the method, the user can recognize the clogging of the filter without disassembling the filter from the washing machine and without checking the interior of the filter, so the user does not need to frequently check and clean the filter by disassembling the filter from the washing machine.

10 Claims, 3 Drawing Sheets

METHOD OF DETECTING THE CLOGGING OF A FILTER INSTALLED IN A WASHING MACHINE

BACKGROUND OF THE INVENTION

1. Field of the Invention

The present invention relates to a filter installed in a washing machine, and more particularly to a method of detecting the clogging of a filter installed in a washing machine by which a user can recognize the clogging of the filter.

2. Prior Arts

A washing machine is an appliance for separating dirt from articles being washed such as clothing by sequentially carrying out various cycles in the order of liquid feeding, washing, rinsing, dehydrating, and draining cycles.

While the washing cycle is being executed, washing liquid supplied from a liquid source is circulated into a spraying nozzle mounted on an upper portion of the washing machine through a circulation pump and then is sprayed onto clothing, thereby improving the washing effect. While the washing liquid is being circulated, a filter installed in a water-flowing path filters impurities such as lint or hairs contained in the washing liquid, thereby not only preventing a drainage vent from clogging, but also ensuring the high operating efficiency of the washing machine.

However, when a large amount of impurities are accumulated in the filter, the filter is clogged by the impurities so that the circulation of the washing liquid passing through the filter may be interrupted. In this case, the circulation pump circulating the washing liquid is subjected to an overload, so the operating efficiency of the washing machine is lowered.

Accordingly, there is a disadvantage in that the user should frequently check and clean the friar by disassembling the filter from the washing machine.

SUMMARY OF THE INVENTION

The present invention has been made to overcome the above described problem of the prior art, and accordingly, it is an object of the present invention to provide a method of detecting the clogging of a filter installed in a washing machine in such a manner that a user can recognize the clogging of the filter.

To achieve the above object, the present invention provides a method of detecting a clogging of a filter installed in a water-flowing path of a washing machine. The washing machine has an outer tub for receiving a washing liquid, a spin tub rotatably accommodated in the outer tub, a pulsator mounted on a bottom wall of the spin tub, a circulation pump for circulating the washing liquid into an upper portion of the outer tub, a microcomputer, and a liquid level sensor which sends various frequency data based on liquid levels in the outer tub to the microcomputer. The method comprises the steps of:

(1) feeding the washing liquid from a liquid source into the outer tub;

(2) detecting a first frequency using the liquid level sensor when a liquid level in the outer tub has reached a first liquid level which is appropriate for washing an article to be washed, and recording a value of the first frequency in a memory section of the microcomputer;

(3) performing a washing cycle by rotating the pulsator;

(4) detecting a second frequency using the liquid level sensor when a liquid level in the outer tub has reached a second liquid level which is formed in the outer tub while the washing cycle is being executed, and recording a value of the second frequency in the memory section of the microcomputer;

(5) calculating a value of a third frequency by subtracting the value of the first frequency from the value of the second frequency; and (6) sending an operating signal to a signal lamp when the value of the third frequency is lower than a predetermined frequency range which is preset in the microcomputer.

According to a preferred embodiment of the present invention, the washing liquid circulates into the upper portion of the outer tub through the circulation pump and then is sprayed onto the article while step (3) is being executed.

According to a preferred embodiment of the present invention, the method further comprises the steps of:

(7) determining whether or not the washing cycle has been completed;

(8) performing rinsing and dehydrating cycles; and (9) draining the washing liquid out of the washing machine.

Steps (3) to (7) are repeated when the washing cycle has not been completed in step (7).

According to the method of the present invention, the user can recognize the clogging of the filter without disassembling the filter from the washing machine and checking the interior of the filter, so the user does not need to frequently check and clean the falter by disassembling the filter from the washing machine.

Furthermore, according to the method of the present invention, the user can recognize the clogging of the filter while the washing cycle is being executed, so the circulation pump can be prevented from being subjected to the overload which occurs during the washing cycle when the filter is clogged.

BRIEF DESCRIPTION OF THE DRAWINGS

The above object, and other features and advantages of the present invention will become more apparent by describing in detail a preferred embodiment thereof with reference to the attached drawings, in which.

DESCRIPTION OF THE PREFERRED EMBODIMENTS

Hereinafter, the present invention will be described in detail with reference to the accompanying drawings.

Figure 1:
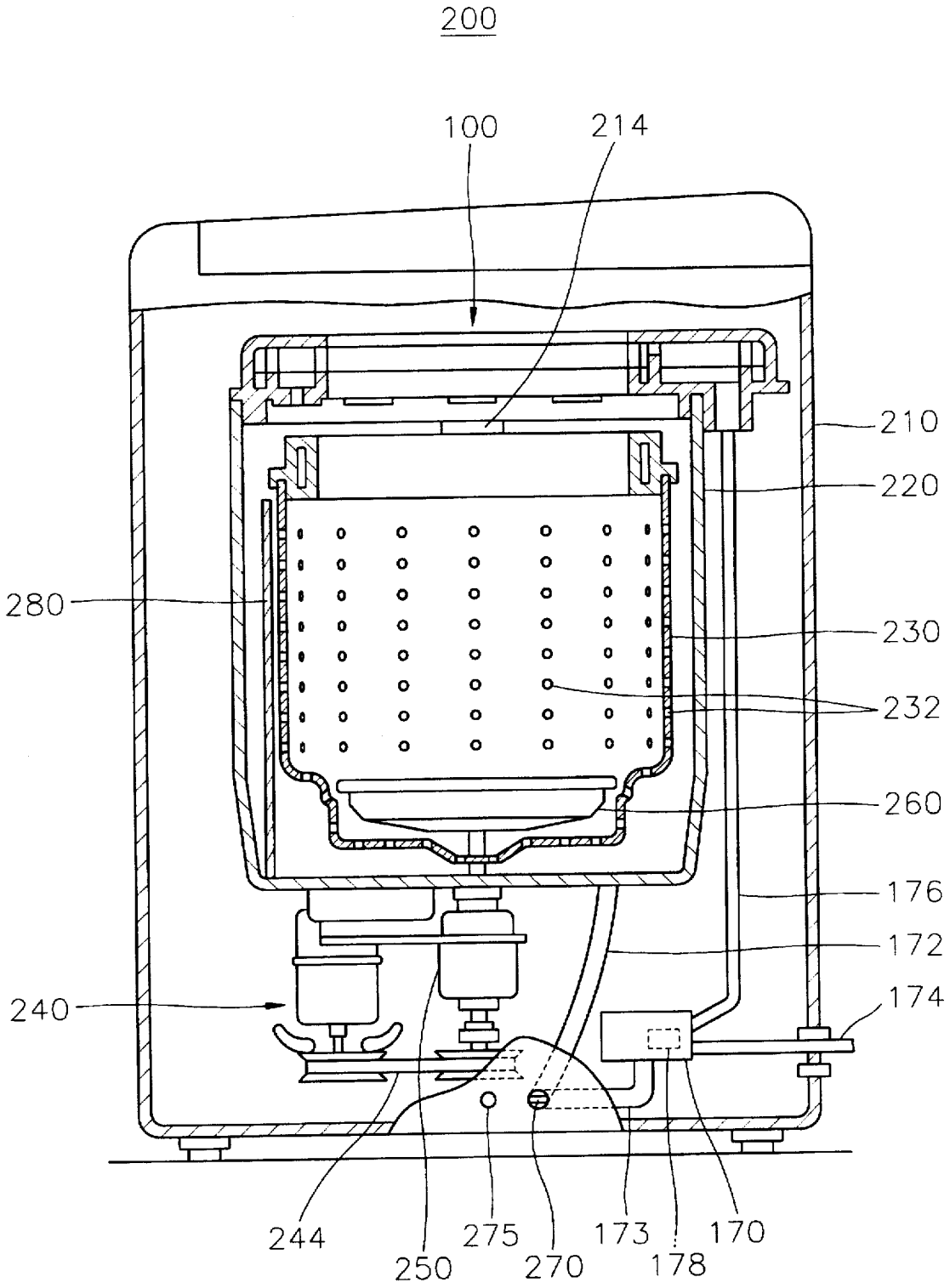
FIG. 1 is a sectional view of a washing machine by which a method of the present invention is performed.

FIG. 1 shows a washing machine 200 for performing a method according to one embodiment of the present invention.

As shown in FIG. 1, washing machine 200 has a housing 210. An outer tub 220 for receiving the washing liquid and a spin tub 230 which is accommodated in outer tub 220 and formed at its side wall with a plurality of discharging holes 232 are disposed in housing 210. Provided at the lower portion of housing 220 are a main motor 240 generating a rotational force and a gear assembly 250 which receives the rotational force from main motor 240 then transfers the rotational force to spin tub 230 or to a pulsator 260 mounted on a bottom wall of spin tub 230. A spraying nozzle assembly 100 is mounted on an upper portion of outer tub 220 in order to spray the washing liquid into the clothing.

A filter 270 for filtering impurities such as lint or hairs is provided at a outer lower wall of housing 210. Filter 270 is detachable from the outside of washing machine 200. In addition, a signal lamp 275 for displaying the clogging of filter 270 is provided in the vicinity of filter 270.

Filter 270 is connected to outer tub 220 through a first discharge pipe 172, and is connected to a circulation pump 170 through a second discharge pipe 173. Circulation pump 170 circulates the washing liquid having passed filter 270 into spraying nozzle assembly 100 through a circulation tube 176 or drains the washing liquid out of washing machine 200 through a draining tube 174. In order to drive circulation pump 170, a pump motor 178 is provided in circulation pump 170.

A liquid feeding chamber 214 is formed at the upper inner wall of outer tub 220 in order to supply the washing liquid into outer tub 220 when washing machine 200 operates. A detergent bucket (not shown) is inserted into liquid feeding chamber 214, so a washing liquid mixed with the detergent is supplied into outer tub 220 when washing machine 200 operates.

In addition, a liquid level sensor 280 for sensing a liquid level in washing machine 200 is fixed in the bottom wall of outer tub 220 and longitudinally extends up to the upper portion of outer tub 220. Liquid level sensor 280 has an oscillator therein. The oscillator sends various frequency data based on the liquid levels in outer tub 220 to a microcomputer, so that the microcomputer may recognize the liquid level in outer tub 220. The oscillator generates lower frequencies as pressure applied thereto is higher. Therefore, the oscillator generates lower frequencies as the liquid level in outer tub 220 becomes higher.

Figure 2:
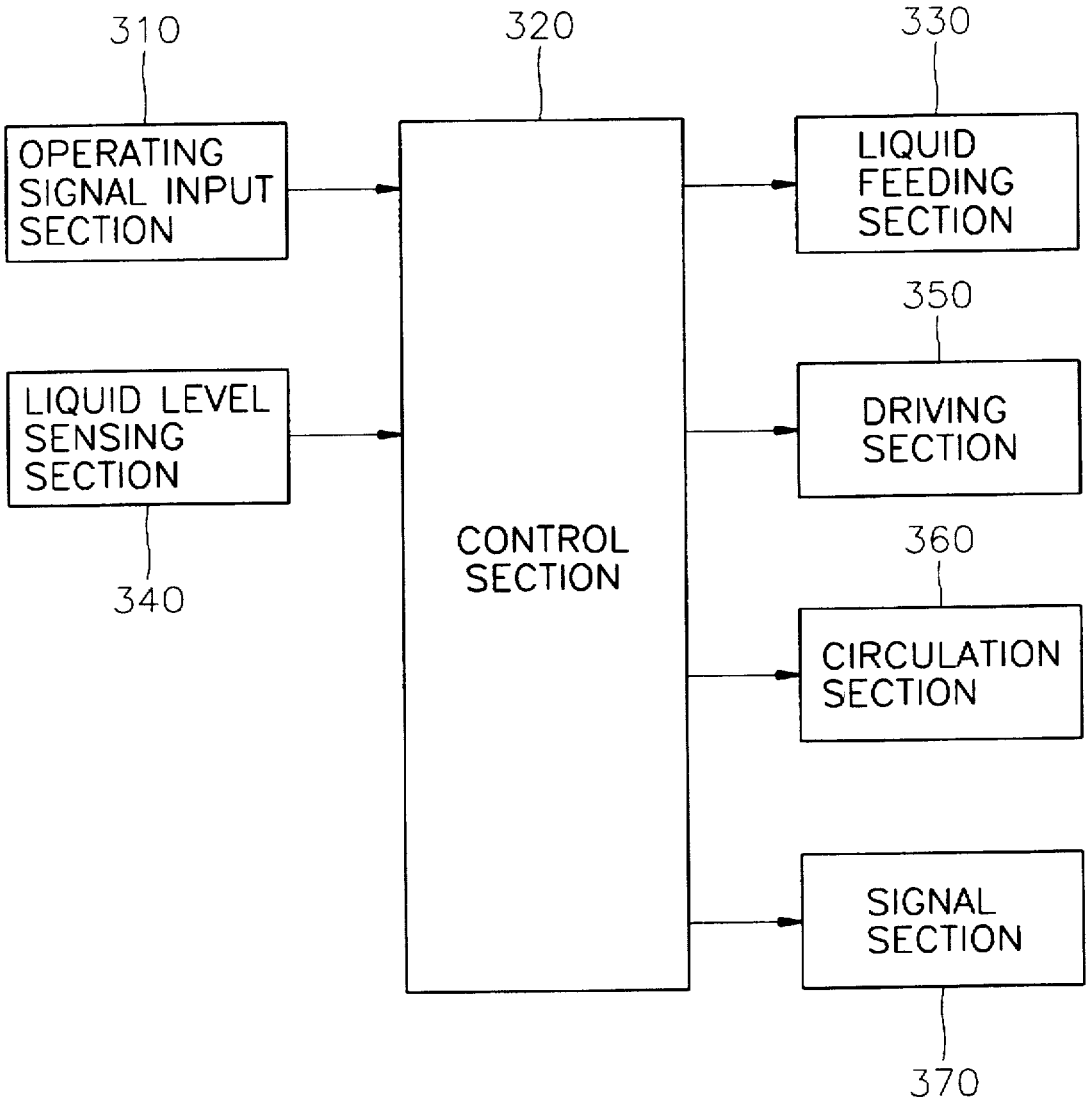
FIG. 2 is a block diagram showing the schematic construction of the washing machine shown in FIG. 1.

FIG. 2 is a block diagram showing the schematic construction of washing machine 200.

As shown in FIG. 2, washing machine 200 has an operating signal input section 310, a control section 320 which generates a control signal according to a predetermined algorithm upon receiving an operating signal from operating signal input section 310, a liquid feeding section 330 for supplying the washing liquid into outer tub 220 when a liquid feeding signal is inputted from control section 320, a liquid level sensing section 340 which detects the liquid level in outer tub 220 and sends data thereof to control section 320, a driving section 350 which rotates spin tub 230 or pulsator 260 when a driving signal is inputted from control section 320, a circulation section 360 which circulates the washing liquid filled in outer tub 220 into the upper portion of outer tub 220 and then sprays the circulated washing liquid onto the clothing according to a signal inputted from control section 320, and a signal section 370 which displays the clogging of filter 270.

Control section 320 includes a microcomputer, and liquid level sensing section 340 includes liquid level sensor 280. In addition, circulation section 360 includes circulation pump 170, circulation robe 176, and spraying nozzle assembly 100. Signal section 370 includes signal lamp 275.

Figure 3:
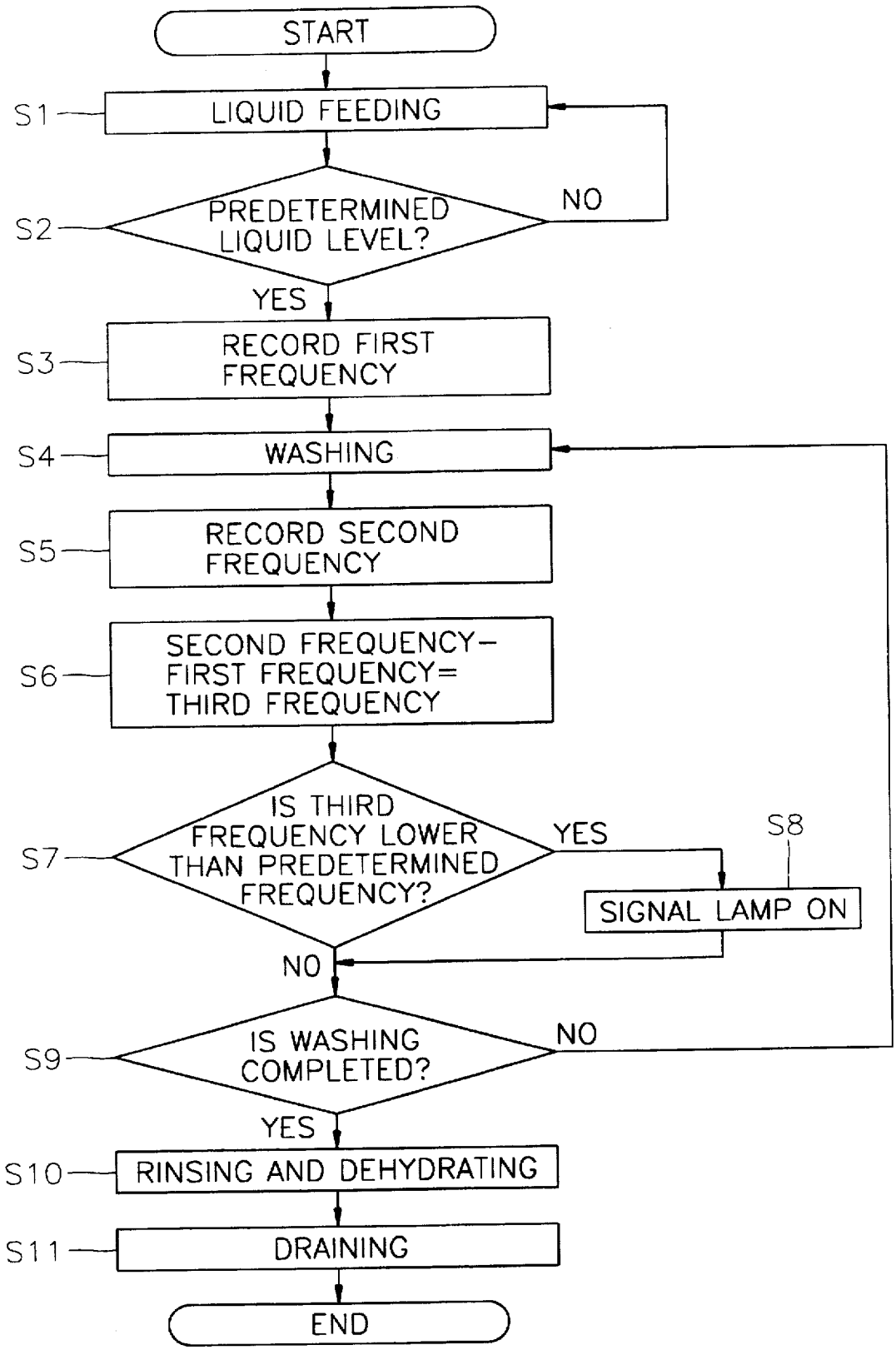
FIG. 3 is a flow chart of a method of detecting the clogging of a filter according to one embodiment of the present invention.

FIG. 3 shows a flow chart of the method of detecting the clogging of filter 270 according to one embodiment of the present invention. Hereinafter, the method of the present invention will be described with reference to FIG. 3.

Firstly, when a user pushes an operating button, the operating signal is inputted to control section 320 from operating signal Input section 310. Upon receiving the operating signal from operating signal input section 310, control section 320 applies the liquid feeding signal to liquid feeding section 330 so that the washing liquid is introduced from a liquid source into outer tub 220 through liquid feeding chamber 214 (step S1).

At this time, liquid level sensing section 340 sends frequency data based on the liquid level in outer tub 220 to control section 320. Then, control section 320 determines whether or not the liquid level in outer tub 220 has reached a predetermined level which is preset in control section 320 (step S2).

When the liquid level has reached the predetermined level which is appropriate for washing the clothing, control section 320 sends a signal to liquid feeding section 330 in order to stop the feeding of the washing liquid. At the same time, control section 320 records a first frequency detected by liquid level sensing section 340 in a memory section (step S3).

Then, control section 320 applies a driving signal to driving section 350 so that pulsator 260 may rotate, and thereby, the washing cycle is initiated (step S4).

While the washing cycle is being executed, the washing liquid supplied from liquid feeding section 330 circulates through circulation section 360 and then is sprayed onto the clothing. Accordingly, the liquid level in outer tub 220 is lower than the predetermined liquid level which is preset in control section 320, so liquid level sensing section 340 sends a second frequency which is higher than the first frequency to control section 320. Upon receiving the second frequency, control section 320 records the second frequency in the memory section (step S5).

Next, control section 320 calculates a third frequency by subtracting the value of the first frequency from the value of the second frequency (step S6).

Then, control section 320 determines whether or not the value of the third frequency is within a predetermined frequency range which is preset in control section 320 (step S7).

In step S7, if the third frequency is lower than the predetermined frequency range, control section 320 determines that the circulation of the washing liquid is interrupted by impurities accumulated in filter 270, so control section 320 sends an operating signal to signal lamp 275 (step S8). Therefore, the user can recognize the clogging of filter 270. At this time, the user can clean filter 270 immediately by stopping the operation of washing machine 200, or alternatively, the user can clean filter 270 after the operation of washing machine 200 has been completed.

On the other hand, if the third frequency is within the predetermined frequency range in step S7, control section 320 determines that filter 270 is in a normal state.

Next, control section 320 determines whether or not the washing cycle has been completed (step S9). If the washing cycle has not been completed in step S9, steps S4 to S9 may repeat. On file other hand if the washing cycle has been completed in step S9, the rinsing and dehydrating cycles are initiated (step S10). In the rinsing cycle, control section 320 applies the liquid feeding signal to liquid feeding section 330 again, so that a rinsing liquid is introduced from the liquid source into outer tub 220 through liquid feeding chamber 214.

When the rinsing and dehydrating cycles have finished, the rinsing liquid remaining in outer tub 220 is sucked into circulation pump 170 through first discharge pipe 172, and then is drained out of washing machine 200 through second discharge pipe 173 and draining tube 174 (step S11). If filter 270 is in the normal state, signal lamp 275 is maintained in the OFF state even when the operation of washing machine 200 has finished. Accordingly, it is not required for the user to check and clean filter 270 by disassembling filter 270 from washing machine 200.

As described above, according to the method of the present invention, the user, can recognize the clogging of the filter without disassembling the filter from the washing machine and without checking the interior of the filter, so the user does not need to frequently check and clean the filter by disassembling the filter from the washing machine.

Furthermore, according to the method of the present invention, the user can recognize the clogging of the filter while the washing cycle is being executed, so the circulation pump can be prevented from being subjected to the overload which occurs during the washing cycle when the filter is clogged.

While the present invention has been particularly shown and described with reference to the preferred embodiment thereof, it will be understood by those skilled in the art that various changes in form slid detail may be effected therein without departing from the spirit and scope of the invention as defined by the appended claims.

What is claimed is:

1. A method of detecting a clogging of a filter installed in a water-flowing path of a washing machine having an outer tub for receiving a washing liquid, a spin tub rotatably accommodated in the outer tub, a pulsator mounted on a bottom wall of the spin tub, a circulation pump for circulating the washing liquid into an upper portion of the outer tub, a microcomputer, and a liquid level sensor which sends various frequency data based on liquid levels in the outer tub to the microcomputer, the method comprising steps of:

(1) feeding the washing liquid from a liquid source into the outer tub;

(2) detecting a first frequency using the liquid level sensor when a liquid level in the outer tub has reached a first liquid level which is appropriate for washing an article to be washed and recording a value of the first frequency in a memory section of the microcomputer;

(3) performing a washing cycle by rotating the pulsator;

(4) detecting a second frequency using the liquid level sensor when a liquid level in the outer tub has reached a second liquid level which is formed in the outer tub while the washing cycle is being executed, and recording a value of the second frequency in the memory section of the microcomputer;

(5) calculating a value of a third frequency by subtracting the value of the first frequency from the value of the second frequency; and (6) sending an operating signal to a signal lamp when the value of the third frequency is lower than a predetermined frequency range which is preset in the microcomputer.

2. The method as claimed in claim 1, wherein the washing liquid circulates into the upper portion of the outer tub through the circulation pump and then is sprayed onto the article while step (3) is being executed.

3. The method as claimed in claim 1, further comprising the step of determining whether or not the value of the third frequency is within the predetermined frequency range between steps (5) and (6).

4. The method as claimed in claim 1, further comprising the steps of:

(7) determining whether or not the washing cycle has been completed;

(8) performing rinsing and dehydrating cycles; and (9) draining the washing liquid out of the washing machine.

5. The method is claimed in claim 4, wherein steps (3) to (7) are repeated when the washing cycle has not been completed in step (7).

6. A method of detecting a clogging of a filter installed in a water-flowing path of a washing machine having an outer tub for receiving a washing liquid, a spin tub rotatably accommodated in the outer tub, a pulsator mounted on a bottom wall of the spin tub, a circulation pump for circulating the washing liquid into an upper portion of the outer tub, a microcomputer, and a liquid level sensor which sends various frequency data based on liquid levels in the outer tub to the microcomputer, the method comprising the steps of:

(1) feeding the washing liquid from a liquid source into the outer tub until a liquid level in the outer tub has reached a first liquid level which is appropriate for washing an article to be washed;

(2) detecting a first frequency based on the first liquid level using the liquid level sensor, and recording a value of the first frequency in a memory section of the microcomputer;

(3) performing a washing cycle by rotating the pulsator;

(4) detecting a second frequency using the liquid level sensor when a liquid level in the outer tub has reached a second liquid level which is formed in the outer tub while the washing cycle is being executed, and recording a value of the second frequency in the memory section of the microcomputer;

(5) calculating a value of a third frequency by subtracting the value of the first frequency from the value of the second frequency;

(6) determining whether or not the value of third frequency is within the predetermined frequency range;

(7) sending an operating signal to a signal lamp when the value of the third frequency is lower than a predetermined frequency range which is preset in the microcomputer.

7. The method as claimed in claim 6, wherein the washing liquid circulates into the upper portion of the outer tub through the circulation pump and then is sprayed onto the article while step (3) is being executed.

8. The method as claimed in claim 6, further comprising the steps of:

(8) determining whether or not the washing cycle has been completed;

(9) performing rinsing and dehydrating cycles; and

(10) draining the washing liquid out of the washing machine.

9. The method as claimed in claim 8, wherein steps (3) to (8) are repeated when the washing cycle has not been completed in step (7).

10. A method of detecting a clogging of a filter installed in a water-flowing path of a washing machine having an outer tub for receiving a washing liquid, a spin tub rotatably accommodated in the outer tub, a pulsator mounted on a bottom wall of the spin tub, a circulation pump for circulating the washing liquid into an upper portion or the outer tub, a microcomputer, and a liquid level sensor which sends various frequency data based on liquid levels in the outer tub to the microcomputer, the method comprising the steps of:

(1) feeding the washing liquid from a liquid source into the outer tub until a liquid level in the outer tub has reached a first liquid level which is appropriate for washing an article to be washed;

(2) detecting a first frequency base on the first liquid level using the liquid level sensor, and recording a value of the first frequency in a memory section of the microcomputer;

(3) performing a washing cycle by rotating the pulsator while spraying the washing liquid onto the article by circulating the washing liquid into the upper portion of the outer tub through the circulation pump;

(4) detecting a second frequency using the liquid level sensor when a liquid level in the outer tub has reached a second liquid level which is formed in the outer tub while the washing cycle is being executed, and recording a value of the second frequency in the memory section of the microcomputer;

(5) calculating a value of a third frequency by subtracting the value of the first frequency from the value of the second frequency;

(6) determining whether or not the value of the third frequency is within the predetermined frequency range;

(7) sending an operating signal to a signal lamp when the value of the third frequency is lower than a predetermined frequency range which is preset in the microcomputer;

(8) determining whether or not the washing cycle has been completed;

(9) repeating steps (3) to (8) when the washing cycle has not been completed in step (8):

(10) performing rinsing and dehydrating cycles; and

(11) draining the washing liquid out of the washing machine.

* * * * *